United States Patent [19]

Ito et al.

[11] Patent Number: 4,705,092

[45] Date of Patent: Nov. 10, 1987

[54] MANUFACTURING METHOD FOR AN INTEGRAL TYPE CRANKSHAFT BEARING CAP

[75] Inventors: Toshio Ito, Susono; Shunichi Fujio, Aichi; Takeyoshi Taya, Toyoake, all of Japan

[73] Assignee: Toyota Jidosha Kabushiki Kaisha, Toyota, Japan

[21] Appl. No.: 853,718

[22] Filed: Apr. 18, 1986

[30] Foreign Application Priority Data

Apr. 19, 1985 [JP] Japan ..... 60-82226

[51] Int. Cl.[4] ..... B22D 19/04

[52] U.S. Cl. ..... 164/34; 164/98; 164/112; 29/156.5 R; 29/527.5

[58] Field of Search ..... 164/9–11, 164/34–36, 45, 98, 112, 137, 246, 249; 29/156.5 R, 156.5 A, 527.5

[56] References Cited

U.S. PATENT DOCUMENTS 2,830,343 4/1958 Shroyer ..... 164/34
2,842,820 7/1958 Brennan ..... 164/98

FOREIGN PATENT DOCUMENTS 57112056 7/1982 Japan .

*Primary Examiner*—Nicholas P. Godici
*Assistant Examiner*—Richard K. Seidel
*Attorney, Agent, or Firm*—Cushman, Darby & Cushman

[57] ABSTRACT

A method of manufacturing an integral type crankshaft bearing cap for an internal combustion engine. The integral type crankshaft bearing cap comprises crankshaft bearing caps spacedly arranged in the longitudinal direction of the engine and a beam extending in the longitudinal direction of the engine. The manufacturing method comprises making a plurality of models of the crankshaft bearing caps of resin used in full mold casting, arranging the models and connecting the models to the beam, and replacing the resin constituting the models with metal in full mold casting, thereby integrating the replaced metal and the beam.

14 Claims, 7 Drawing Figures

MANUFACTURING METHOD FOR AN INTEGRAL TYPE CRANKSHAFT BEARING CAP

BACKGROUND OF THE INVENTION

1. Field of the Invention

The present invention relates to a manufacturing method of an integral type crankshaft bearing cap for an internal combustion engine. The integral type crankshaft bearing cap is integrated by spacing a plurality of crankshaft bearing caps along a beam to which they are connected.

2. Description of the Prior Art

In internal combustion engine technology, crankshaft bearing caps have been integrated into an integral structure. In the integral type crankshaft bearing cap, a plurality of crankshaft bearing caps are spaced in a longitudinal direction of the engine along a beam extending in the longitudinal direction of the engine to which the caps are connected. Since the integral type crankshaft bearing cap has high rigidity as a whole, rigidity of a cylinder block, to which the integral type crankshaft bearing cap is fixed, is increased, and thereby the level of vibration and noise of the engine is decreased. Two integral type crankshaft bearing cap structures are known. Either the crankshaft bearing caps and the beam are integrally formed using the same material, or the crankshaft bearing caps and the beam are constructed of different kinds of metal.

FIG. 1 shows an example of the former type of integral type crankshaft bearing cap. Crankshaft bearing caps 1 and beam 2 are formed integrally in casting, with crankshaft bearing caps 1 and beam 2 constructed of the same metal. With integral type crankshaft bearing cap 3, if the shape of crankshaft bearing caps 1 is intricate, molds for casting also become intricate and the molds must include a number of split molds. For instance, when recessed portions are formed on the wall of the crankshaft bearing caps to decrease their weight, the molds must be divided into a number of split molds.

However, as the number of split molds increases, the productivity of the integral type crankshaft bearing cap manufacturing process decreases. To raise productivity, it is almost unavoidable to form the portions for the crankshaft bearing caps in the shape as shown in FIG. 1 so as to be able to eliminate molds after casting; that is, crankshaft bearing caps 1 have flat walls and they are formed as plate-like blocks having almost uniform thickness. As a result, crankshaft bearing caps 1 have unnecessary metal with respect to strength, increasing the weight of integral type crankshaft bearing cap 3.

FIG. 2 shows an example of the second type of integral type crankshaft bearing cap using different metals. Such a structure is disclosed, for example, in Japanese Utility Model Publication No. SHO 57-112056. Integral type crankshaft bearing cap 4 in FIG. 2 is constructed of crankshaft bearing caps 5 and two beams 6, and manufactured as follows. Two beams 6 are set in a casting mold defining cavities therein, the cavities being formed in the same shape as crankshaft bearing caps 5. After that, molten metal is poured into the cavities of the mold, forming crankshaft bearing caps 5 around beams 6. In such a manufacturing process, since beams 6 must be set in a mold before casting, it is difficult to divide the mold into a number of split molds. Therefore, the possible shapes for crankshaft bearing caps are restricted, and it becomes difficult to form crankshaft bearing caps in a shape having recessed portions in their walls. As a result, as shown in FIG. 2, crankshaft bearing caps 5 are also formed as flat wall type blocks, with unnecessary portions increasing their weight.

Thus, in conventional structures made by conventional manufacturing processes, it is difficult to decrease weight by complicating the shape of the crankshaft bearing caps while maintaining an acceptible level of productivity.

SUMMARY OF THE INVENTION

An object of the present invention is to provide a manufacturing method for an integral type crankshaft bearing cap which can form crankshaft bearing caps having a shape which optimizes strength and weight, and at the same time can improve manufacturing productivity.

A method of manufacturing an integral type crankshaft bearing cap for an internal combustion engine, according to the present invention, satisfies the above object. The manufacturing method according to the present invention comprises the following steps. First, a plurality of resin models of the crankshaft bearing caps are made. Next, the models are connected to a beam extending through all of the models. Finally, the resin is replaced with metal in full mold casting. For example, molding sand is fixed around the models and the beam. Pouring gates communicating with the models are provided in the fixed sand. Molten metal is poured into the portions of models via the pouring gates to replace the resin with the poured metal. The metal and beam are thus integrated as an integral type crankshaft bearing cap.

In the method, the crankshaft bearing caps are first manufactured as resin models. In the stage of making resin models, since each model is made independently from other models, it is not necessary to consider directions of eliminating molds in molding. Therefore, the shape of models can be determined freely, and the models can be easily formed even in complicated shapes. As a result, resin models are easily formed in shapes in which unnecessary portions are eliminated from the wall but sufficient strength is maintained.

Since the resin models are replaced with metal in full mold casting, it becomes unnecessary to divide molds for crankshaft bearing caps into split molds, and thereby the productivity is improved. At the same time, the crankshaft bearing caps are formed in an optimum shape from the view point of both strength and weight.

Since the beam is manufactured independently from the resin models, the beam also can have an optimum shape, further decreasing the weight of the integral type crankshaft bearing cap and further improving productivity. Moreover, since the models are replaced with molten metal and the metal surrounds the beam in full mold casting, the metal constituting the crankshaft bearing caps and the beam are connected naturally without any particular connecting process such as welding etc.

BRIEF DESCRIPTION OF THE DRAWINGS

The above and other objects, features and advantages of the present invention will become apparent and more readily appreciated from the following detailed description of the preferred exemplary embodiments of the invention, taken in conjunction with the accompanying drawings, in which.

DETAILED DESCRIPTION OF THE PREFERRED EMBODIMENTS

Figure 3:
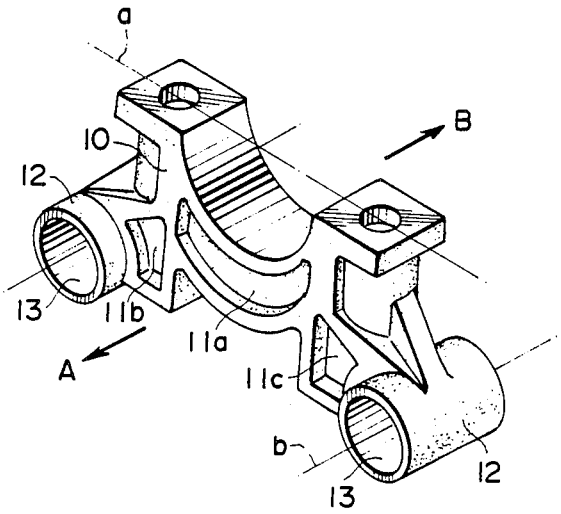
FIG. 3 is an oblique view of a resin model in a manufacturing method of an integral type crankshaft bearing cap according to one embodiment of the present invention.

FIG. 3 shows a model 10 of a crankshaft bearing cap, model 10 having the same shape as the crankshaft bearing cap. In a manufacturing method according to the present invention, a plurality of models 10 are made of resin used in full mold casting. In this embodiment, the resin is thermoplastic resin which volatilizes when heated to a high temperature, for example foamed polystyrene. The number of models 10 being manufactured for an internal combustion engine is the same as the number of crankshaft bearing caps of the engine.

Models 10 are formed in a conventional mold. Each model 10 is molded independently from other models 10. Since each model 10 is formed in one set of molds, there is no interference of the molds with other members when removing the molds after the resin is injected and cooled. Therefore, it is almost unnecessary to consider the removing direction of the molds, even if models 10 are formed in a complicated shape and even if the molds are constructed of many split molds.

In the embodiment, as shown in FIG. 3, model 10 is formed in a shape having recessed portions 11*a*, 11*b* and 11*c* on the wall thereof. The recessed portions 11*a*, 11*b* and 11*c* are unnecessary from the view point of strength of the crankshaft bearing cap. Therefore, the strength or the rigidity of the crankshaft bearing cap corresponding to model 10 is not reduced by providing recessed portion 11*a*, 11*b* and 11*c* but the weight of the crankshaft bearing cap can be reduced. Model 10, having recessed portions 11*a*, 11*b*, 11*c* and other uneven surfaces, can be formed easily as follows. Appropriate front and rear molds (not shown) are separable in a direction of axis b. A flat divisional surface between the front mold (or molds) and the rear mold (or molds) is provided along axis a and extending perpendicularly to axis b. After resin is injected into a cavity of the set molds and cooled, the front mold (or molds) is removed in direction A and the rear mold (or molds) is removed in direction B. Thus, model 10 is formed in an optimum shape satisfying requirements of both strength and weight of the crankshaft bearing cap.

Although one example has been described for forming model 10, the direction of removing molds and the number of split molds can be determined in accordance with the shape of model 10. Since the shape of every crankshaft bearing cap arranged in the longitudinal direction of an engine is usually the same, only one set of molds for model 10 may be prepared to manufacture a plurality of models 10.

At the lower portion of model 10, two pipe portions 12 are integrally formed. Pipe portions 12 form hollow areas 13 through which a beam is passed.

Figure 4:
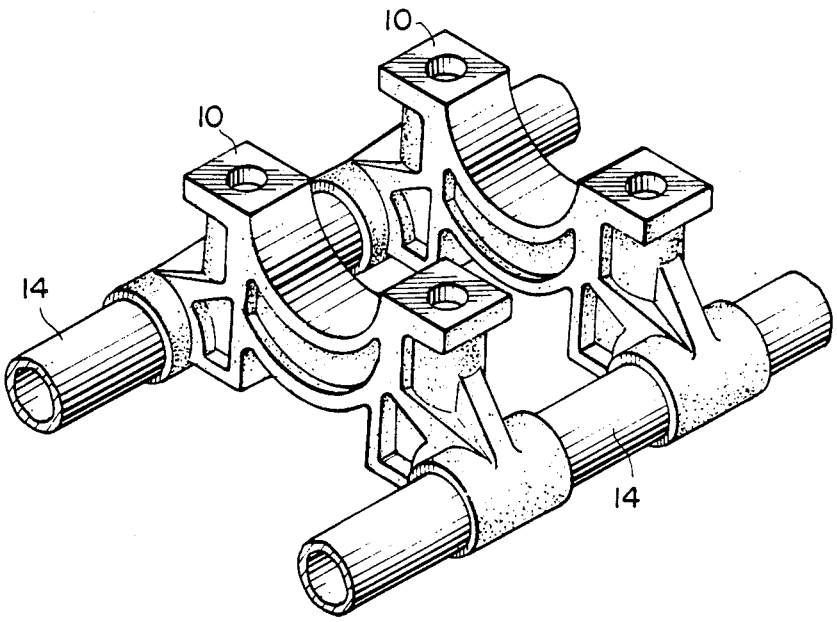
FIG. 4 is a partial oblique view of the resin models and a beam means in the manufacturing method of the integral type crankshaft bearing cap according to the embodiment of the present invention.

Actually two beam portions 14 extend in the longitudinal direction of the engine, as shown in FIG. 4. Beam portions 14 consist of pipes in this embodiment. After making a plurality of models 10, models 10 are arranged in parallel and appropriately spaced from each other, and beam portions 14 are passed through arranged models 10.

Figure 5:
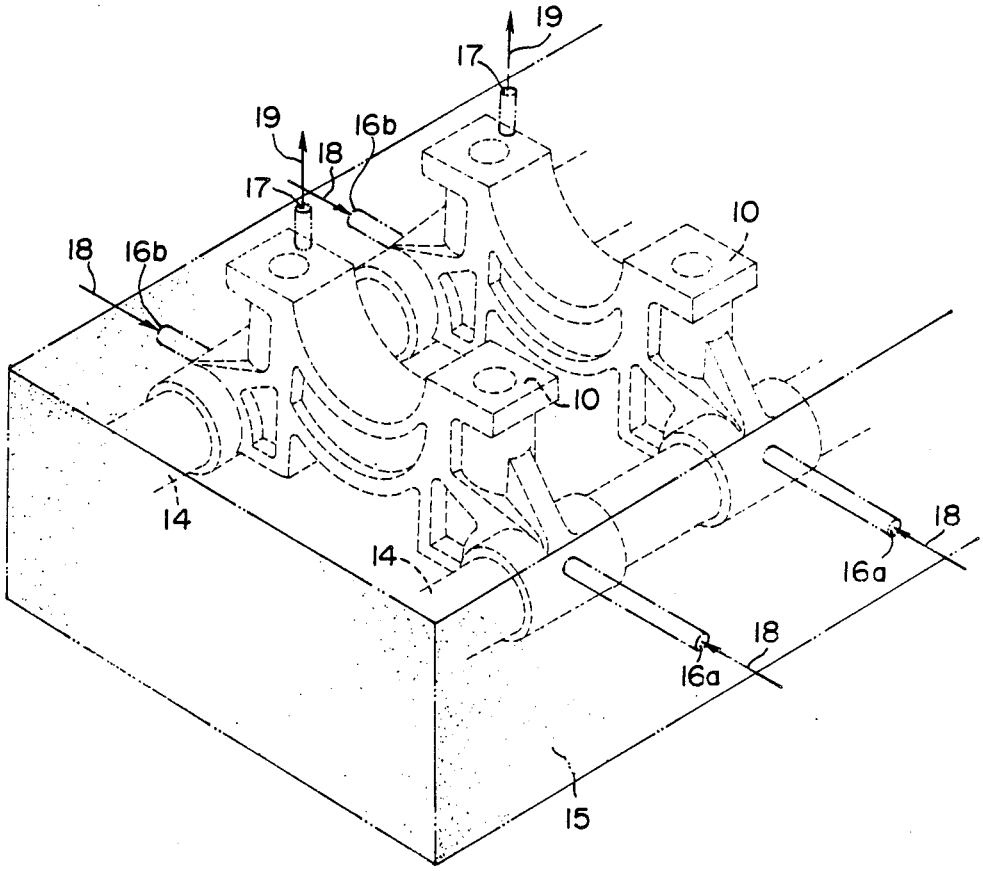
FIG. 5 is a partial oblique view of the integral type crankshaft bearing cap showing a method of full mold casting according to the embodiment of the present invention.

Next, molding sand 15 for full mold casting is fixed around the resin-beam assembly as shown in FIG. 5. At the same time, pouring gates 16*a* and 16*b* are set in molding sand 15. Pouring gates 16*a* and 16*b* are appropriate pipes which communicate with models 10 near positions where models 10 are connected to beam portions 14. In the embodiment, two pouring gates 16*a* and 16*b* are provided for each model 10, and they communicate with each model 10 near two positions respectively where model 10 is connected to beam portions 14. Exhausting gate 17 for gas and resin which should be exhausted is connected to an appropriate position of the upper portion of each model 10.

After molding sand 15, pouring gates 16*a* and 16*b* and exhausting gates 17 are positioned, molten metal is poured into pouring gates 16*a* and 16*b* as shown with arrows 18. The resin constituting models 10 is replaced with molten metal poured through pouring gates 16*a* and 16*b* in full mold casting, and gas and resin melted by the molten metal are exhausted out of exhausting gates 17, as shown with arrows 19. The metal is then cooled, and molding sand 15, pouring gates 16*a*, 16*b* and exhausting gates 17 are eliminated. Since the entirety of each resin model 10 is replaced with metal in full mold casting, the replaced metal assumes the same shape as models 10 so that the each molded metal portion constitutes a portion of crankshaft bearing cap. Each molded metal portion surrounds beam portions 14, connecting each molded metal portion to beam portions 14. Since beam portions 14 are surrounded by molten metal in the full mold casting, an additional particular connecting method, for example welding, is not necessary, and sufficient connecting strength between the molded metal portions and beam portions 14 is obtained by only casting.

The molded metal and beam portions 14 may be of the same kind of metal, or may be of different metals. When the same metal is used, the molded metal and beam portions 14 can be fused to each other, strengthening the connection therebetween. When different metals are used, since optimum materials can be independently selected for the molded metal and beam portions 14, increased strength and reduced weight of the entire integral type crankshaft bearing cap can be achieved.

Figure 1:
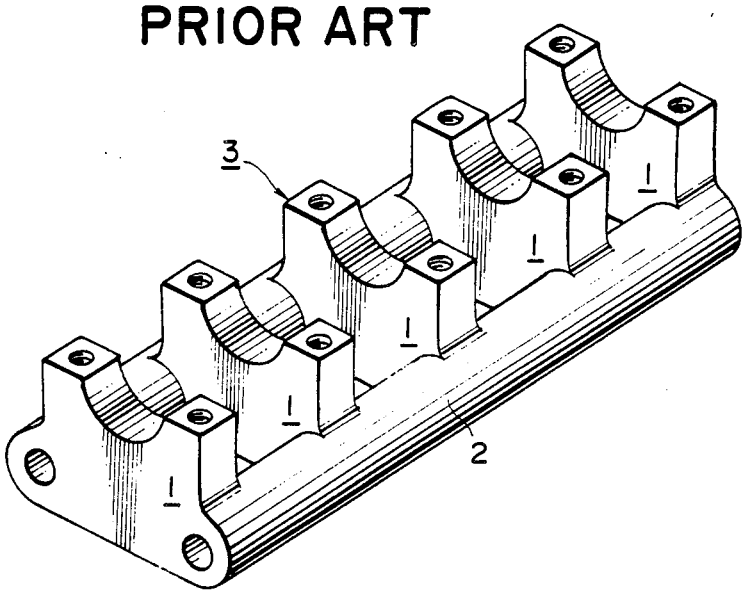
FIG. 1 PRIOR ART
FIG. 1 is an oblique view of a conventional integral type crankshaft bearing cap.
Figure 2:
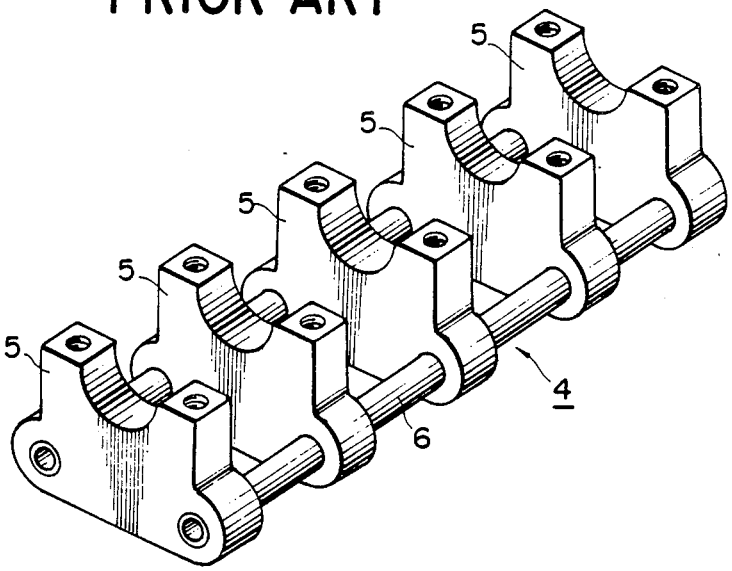
FIG. 2 PRIOR ART
FIG. 2 is an oblique view of another conventional integral type crankshaft bearing cap.
Figure 6:
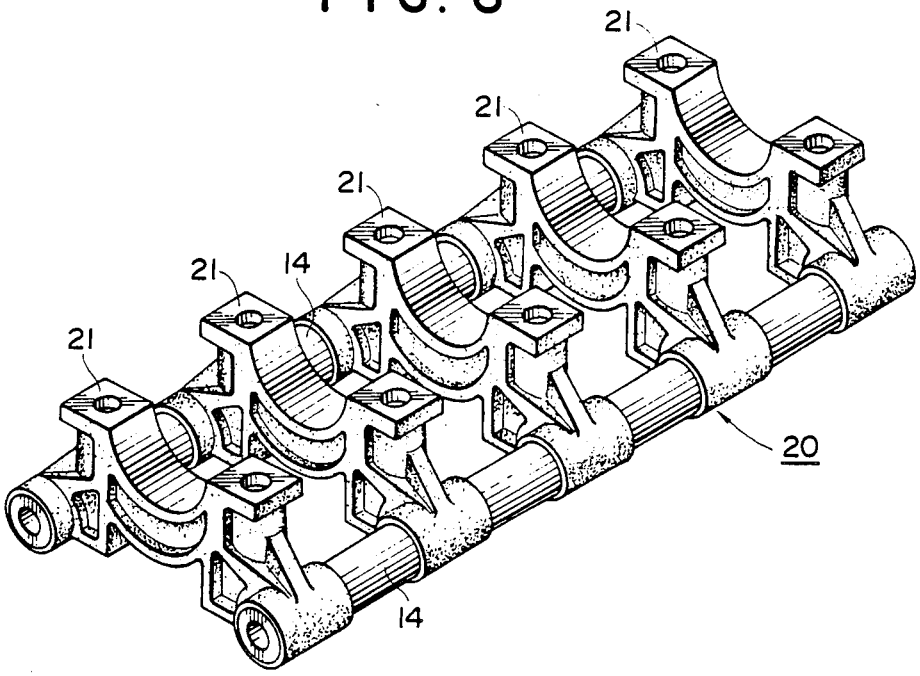
FIG. 6 is an entire oblique view of the integral type crankshaft bearing cap manufactured completely according to the embodiment of the present invention.

Thus, an integral type crankshaft bearing cap 20 is completed as shown in FIG. 6. Integral type crankshaft bearing cap 20 is constituted by crankshaft bearing caps 21, constructed of molded metal, and pipe beams 14. In the manufacturing method, since crankshaft bearing caps 21 can be easily formed in a complicated shape, the weight of integral type crankshaft bearing cap 20 is reduced as a whole compared with conventional structure such as shown in FIG. 1 or FIG. 2. At the same time, the strength and rigidity of crankshaft bearing caps 21 are ensured. Since crankshaft bearing caps 21 are formed by replacing resin with metal in full mold casting after making models 10, it is not necessary to consider split molds for casting and the direction of molds in casting. Therefore the productivity of manufacturing the integral type crankshaft bearing cap 20 can be highly improved. Since models 10 can be formed by one set of molds, the molds may be small-sized, reducing the cost of manufacturing. Moreover, since crankshaft bearing caps 21 and beam portions 14 are connected naturally by replacing resin with metal in full mold casting, the manufacturing process can be simplified.

Figure 7:
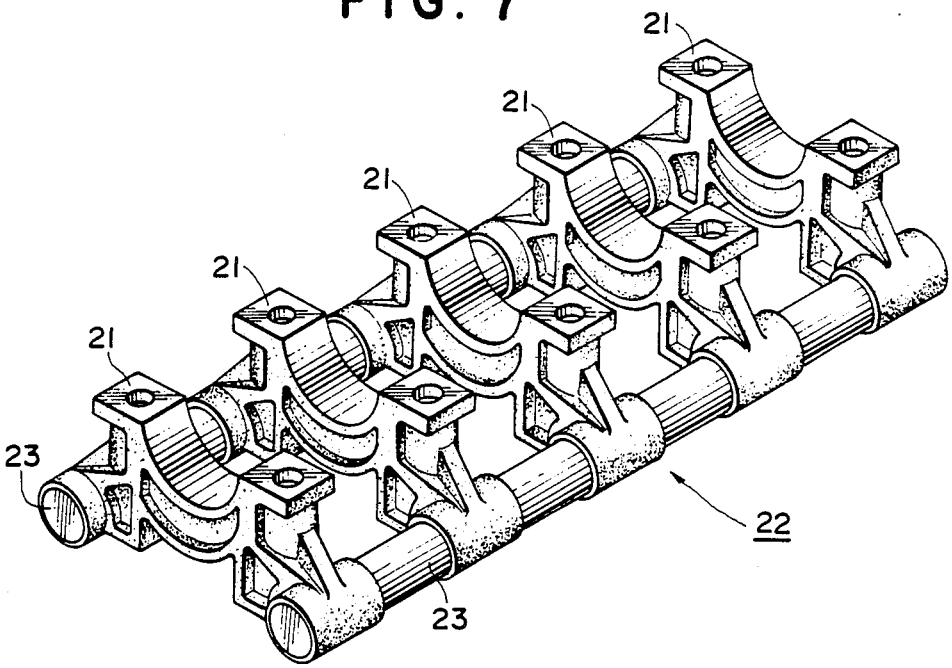
FIG. 7 is an entire oblique view of an integral type crankshaft bearing cap manufactured completely according to another embodiment of the present invention.

FIG. 7 shows another embodiment of an integral type crankshaft bearing cap formed by a manufacturing method according to the present invention. In integral type crankshaft bearing cap 22, beam portions 23 are solid rods. Crankshaft bearing caps 21 in FIG. 7 are formed in the same shape as the caps in FIG. 6 by the same manufacturing method as described above. Thus, a beam may be formed in appropriate structure.

Although only several preferred embodiments of the present invention have been described in detail, it will be appreciated by those skilled in the art that various modifications and alterations can be made to the particular embodiments shown without materially departing from the novel teachings and advantages of this invention. Accordingly, it is to be understood that all such modifications and alterations are included within the scope of the invention as defined by the following claims.

What is claimed is:

1. A method of manufacturing an integral type crankshfat bearing cap for an internal combustion engine, said integral type crankshaft bearing cap including a beam and a plurality of crankshaft bearing caps disposed at longitudinally spaced locations along at least a portion of the length of said beam, said beam being adapted to extend in a longitudinal direction of said engine, each said crankshaft bearing cap having a forward face adapted to face toward the front of said engine and a rearward face adapted to face toward the rear of said engine, said method comprising the steps of:

(a) making resin models of said crankshaft bearing caps, each said model having a forward face and a rearward face, each having recessed portions surrounded by rib portions, and a bore for receiving said beam;

(b) passing said beam through said bore of each of said models; and (c) replacing, by full mold casting, said resin of said models with metal, thereby integrating said metal crankshaft bearing caps and said beam to form said integral type crankshaft bearing cap.

2. The method of claim 1, wherein said resin is thermoplastic resin which volatilizes when heated.

3. The method of claim 1, wherein said metal and said beam are the same kind of metal.

4. The method of claim 1, wherein said metal and said beam are different kinds of metal.

5. The method of claim 1, wherein said making step includes the step of forming said models in a mold.

6. The method of claim 5, wherein said forming step includes the step of forming said models in a plurality of split molds.

7. The method of claim 1, wherein said making step includes the step of forming at least two models of said plurality of models in the same shape.

8. The method of claim 1, wherein said passing step includes the step of passing two beam portions through all of said models.

9. The method of claim 8, wherein said beam portions are pipes.

10. The method of claim 8, wherein said beam portions are solid rods.

11. The method of claim 1, wherein said replacing step includes the step of fixing molding sand for said full mold casting around said models and said beam.

12. The method of claim 1, wherein said replacing step includes the step of providing pouring gates in said full mold casting, said pouring gates communicating with said models near positions where said models are connected to said beam.

13. The method of claim 12, wherein said providing step includes the step of providing at least one pouring gate for each said model.

14. The method of claim 12, wherein said passing step includes the step of passing two beam portions through all of said models, and said providing step includes the step of providing two said pouring gates for each said model near two positions respectively where each said model is connected to said two beam portions.

* * * * *